US011401081B2

(12) United States Patent
Tuan

(10) Patent No.: US 11,401,081 B2
(45) Date of Patent: Aug. 2, 2022

(54) SEALING STRUCTURE FOR A LID AND A CONTAINER

(71) Applicant: Ronald Tuan, Nantou County (TW)

(72) Inventor: Ronald Tuan, Nantou County (TW)

( * ) Notice: Subject to any disclaimer, the term of this patent is extended or adjusted under 35 U.S.C. 154(b) by 1 day.

(21) Appl. No.: 16/924,207

(22) Filed: Jul. 9, 2020

(65) Prior Publication Data

US 2021/0016934 A1 Jan. 21, 2021

(30) Foreign Application Priority Data

Jul. 19, 2019 (TW) ..... 108125560

(51) Int. Cl.
*B65D 43/02* (2006.01)

(52) U.S. Cl.
CPC .. *B65D 43/021* (2013.01); *B65D 2543/00518* (2013.01); *B65D 2543/00546* (2013.01); *B65D 2543/00953* (2013.01)

(58) Field of Classification Search
CPC ..... B65D 2543/00046; B65D 81/3865; B65D 1/265; B65D 41/00; B65D 43/021; B65D 2543/00518; B65D 2543/00546; B65D 2543/00953; B65D 2543/00092; B65D 21/086; B65D 2543/00972; B65D 43/022; B65D 43/0229; B65D 45/327; B65D 53/00
See application file for complete search history.

(56) References Cited

U.S. PATENT DOCUMENTS

| | | | | |
|---|---|---|---|---|
| 11,155,383 | B2 * | 10/2021 | Brooks | B65D 47/089 |
| 2020/0305589 | A1 * | 10/2020 | Beck | A46B 11/0079 |
| 2020/0305619 | A1 * | 10/2020 | Tsui | A47G 19/22 |
| 2020/0385196 | A1 * | 12/2020 | Haas | B65D 81/3869 |

FOREIGN PATENT DOCUMENTS

TW M301862 U 12/2006

* cited by examiner

*Primary Examiner* — Shawn M Braden
(74) *Attorney, Agent, or Firm* — Bruce Stone LLP; Joseph A. Bruce

(57) ABSTRACT

A sealing structure for a lid and a container includes: the container including a hard material structure, a soft material structure connected to the hard material structure, and an opening at the top, the soft material structure includes a limiting portion, the limiting portion includes a container convex arc section and a container concave arc section connected to the container convex arc section; and the lid covering the opening to form an interference fit with the container, and including a locking portion capable of interlocking with the limiting portion, the locking portion includes a lid concave arc section abutting against the container convex arc section, and a lid convex arc section connected to the lid concave arc section and abutting against the container concave arc section. The sealing structure improves the sealing of the container, preventing leakage of liquid from the container, and making the container easy to carry.

4 Claims, 4 Drawing Sheets

SEALING STRUCTURE FOR A LID AND A CONTAINER

BACKGROUND

Field of the Invention

The present invention relates to a sealing structure, and more particularly to a sealing structure for a lid and a container.

Related Prior Art

Please refer to FIG. 1 which shows one of the drawings of the Taiwan Patent (M301862) about a container for display purpose, and the container essentially includes a container body 1 and a base 2. A fitting portion (not shown) is formed at the bottom of the container body 1, and the top of the base 2 is provided with an engaging portion 3 to be fitted in the fitting portion at the bottom of the container body 1, so as to form a container with a base which can be placed on the display shelf for display. Besides, after being separated from the container body 1, the base 2 can also be used as a lid to seal the opening of the top of the container body 1, so as to prevent the liquid contained therein from spilling out.

However, when the base 2 seals the opening of the top of the container body 1, the sealing tightness is quite insufficient, resulting in gaps. In case of shaking or tilting, the liquid in the container body 1 easily overflows and cannot meet the requirement of tight sealing in use. Furthermore, the structure of the base 2 covering the container body 1 is usually only suitable for indoor use, and cannot be carried outdoor for use, which is inconvenient for users who go out.

The present invention has arisen to mitigate and/or obviate the afore-described disadvantages.

SUMMARY

One objective of the present invention is to provide a sealing structure for a lid and a container, which can be easily carried, and the lid and the container are tightly locked to prevent the leakage of liquid from the container.

To achieve the above objective, a sealing structure for a lid and a container in accordance with the present invention comprises:

the container including a hard material structure, a soft material structure connected to the hard material structure, and an opening at the top of the container, wherein the soft material structure includes a limiting portion, the limiting portion includes a container convex arc section and a container concave arc section connected to the container convex arc section; and the lid configured to cover the opening of the container to form an interference fit with the container, and including a locking portion capable of interlocking with the limiting portion, wherein the locking portion includes a lid concave arc section for abutting against the container convex arc section, and a lid convex arc section connected to the lid concave arc section and configured to abut against the container concave arc section.

Preferably, the soft material structure of the container is disposed to an inner surface of the hard material structure facing an inside of the container, and further includes a soft material surface facing the inside of the container; the lid further includes a covering surface facing the soft material surface, and the locking portion of the lid is located on the covering surface. When the lid covers the opening of the container, the covering surface of the lid abuts against the soft material surface of the container close to the opening of the container so that the covering surface, the soft material surface, an abutting position between the covering surface and the soft material surface and an interlocking position between the limiting portion and the locking portion together form a negative pressure space.

Preferably, the soft material structure is made of silicone, and the hard material structure is made of PA66.

Preferably, the soft material structure includes a soft material surface, the lid includes a covering surface facing the soft material surface, and the soft material surface and the covering surface cooperate with each other to form a negative pressure space.

Preferably, the container includes a foldable soft material structure, the hard material structure includes a connecting portion connected to the foldable soft material structure and the foldable soft material structure and the soft material structure are the same structure but are not connected to each other.

Preferably, the container includes a foldable soft material structure, and the foldable soft material structure and the soft material structure are the same structure and are connected to each other.

Preferably, the lid includes a flip portion protruding from an edge of the opening.

To achieve the above objective, the present invention further provides a sealing structure for a lid and a container, which comprises:

the container including an opening at the top of the container, and a container hard material structure, wherein the container hard material structure includes a container limiting portion, the container limiting portion includes a container convex arc section, and a container concave arc section connected to the container convex arc section; and the lid covering the opening of the container to form an interference fit with the container, and including a lid hard material structure, and a lid soft material structure connected to the lid hard material structure, the lid soft material structure includes a lid locking portion which protrudes and is capable of interlocking with the container limiting portion, the lid locking portion includes a lid concave arc section for abutting against the container convex arc section, and a lid convex arc section connected to the lid concave arc section and abutting against the container concave arc section.

Preferably, the lid soft material structure is made of silicone, the container hard material structure and the lid hard material structure are both made of PA66.

Preferably, the lid soft material structure includes a lid soft material surface, the container includes a container surface facing the lid soft material surface, and the lid soft material surface cooperates with the container surface to define a negative pressure space.

Preferably, the container further includes a foldable soft material structure, the container hard material structure includes a connecting portion connected to the foldable soft material structure, and the foldable soft material structure and the lid soft material structure are the same structure and not connected to each other.

In this way, the present invention proposes a sealing structure for a lid and a container, which essentially comprises the container and the lid. When the container soft material structure is combined with the lid to form an interference fit, the locking portion of the lid presses the limiting portion of the soft material structure, so that the limiting portion of the soft material structure is squeezed and deformed to form a pressure sealing; or, the lid soft material structure is combined with the container hard material structure to form an interference fit, the container limiting portion of the container hard material structure presses the lid locking portion of the lid soft material structure, so that the lid locking portion of the lid soft material structure is pressed and deformed to form a pressure sealing. The above-mentioned pressure sealing technique can make the container and the lid tightly engage to prevent the liquid leakage from the container, so as to facilitate the user to carry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

and

Figure 4:
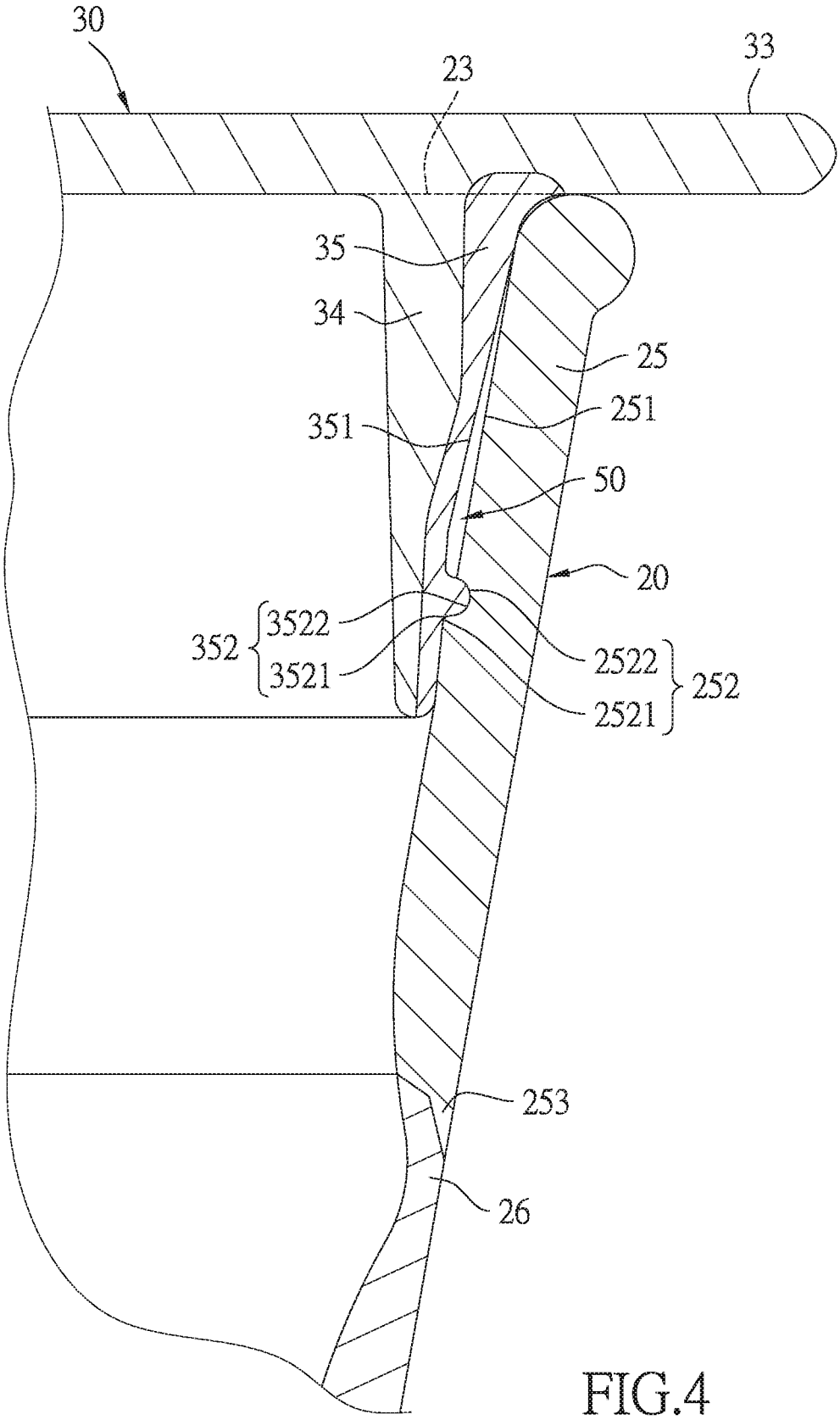

FIG. 4 is a cross-sectional view of a third embodiment of the present invention.

DETAILED DESCRIPTION

The present invention will be clearer from the following description when viewed together with the accompanying drawings, which show, for purpose of illustrations only, the preferred embodiment in accordance with the present invention.

Figure 1:
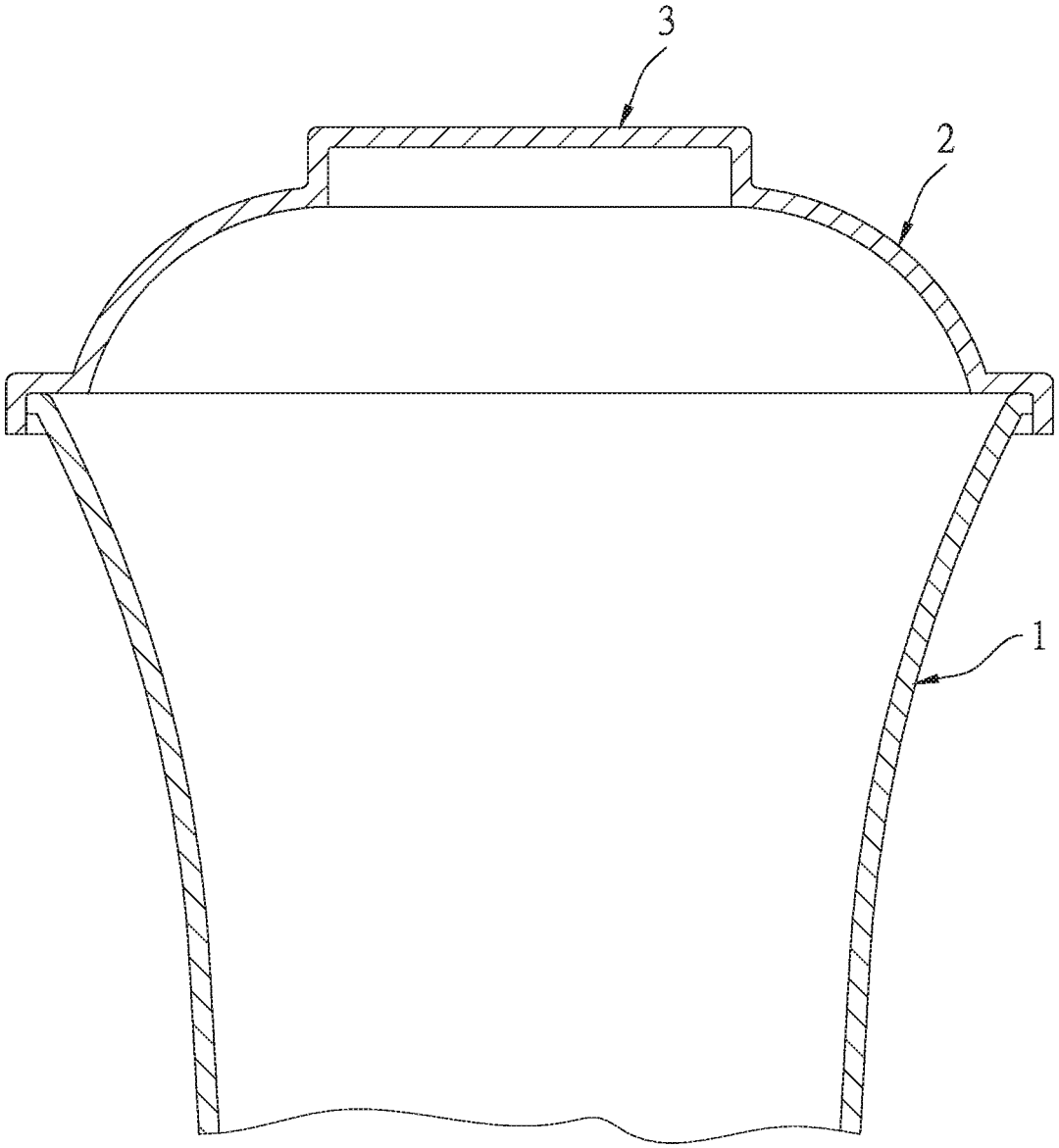
FIG.1 PRIOR ART
FIG. 1 is one of the drawings of the container for displaying purpose disclosed in Taiwan Patent (M301862)
Figure 2:
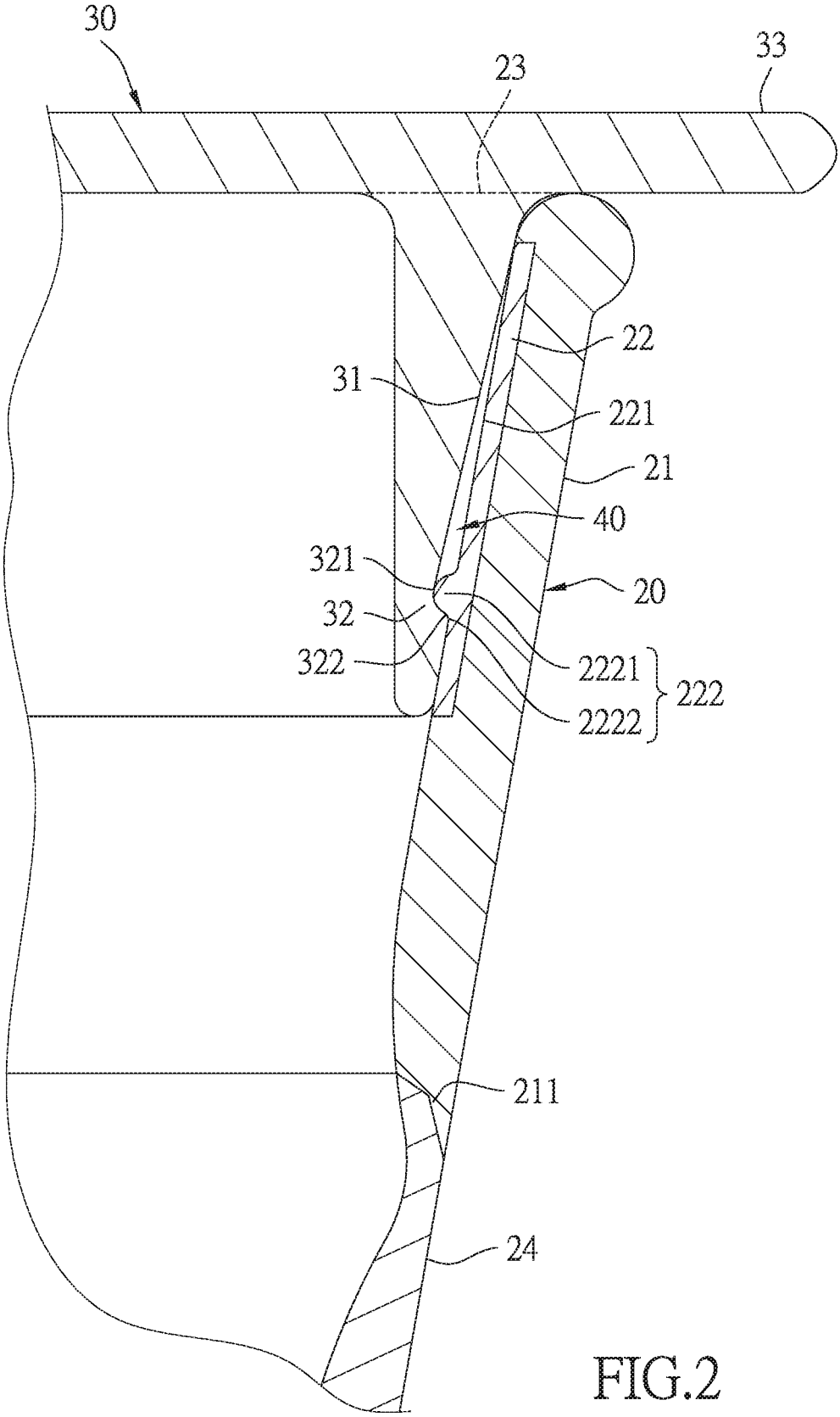
FIG. 2 is a cross-sectional view of a first embodiment of the present invention.

Referring to FIG. 2, a sealing structure for a lid and a container in accordance with a first embodiment of the invention essentially comprises the container 20 and the lid 30.

The container 20 includes a hard material structure 21, a soft material structure 22 which is flexible and connected to the hard material structure 21, an opening 23 at the top of the container 20, and a foldable soft material structure 24 for folding. Specifically, the soft material structure 22 is on an inner surface of the hard material structure 21 facing an inside of the container 20. The foldable soft material structure 24 and the soft material structure 22 have the same structure and are not connected to each other. The hard material structure 21 includes a connecting portion 211 connected to the foldable soft material structure 24. The soft material structure 22 includes a soft material surface 221 facing the inside of the container 20, and a limiting portion 222 protruding from the soft material surface 221. The limiting portion 222 includes a container convex arc section 2221 and a container concave arc section 2222 connected to the container convex arc section 2221. In this embodiment, the soft material structure 22 and the foldable soft material structure 24 are made of silicone as an example, the hard material structure 21 is made of PA66 as an example, but not limited thereto.

The lid 30 covers the opening 23 of the container 20 to form an interference fit with the container 20, and includes: a covering surface 31 facing the soft material surface 221, a locking portion 32 located on the covering surface 31 and capable of interlocking with the limiting portion 222, and a flip portion 33 protruding from an edge of the opening 23. The flip portion 33 has an outer diameter of larger than an outer diameter of the opening 23. Through the design of the flip portion 33, the lid 30 can be easily lifted. The locking portion 32 includes a lid concave arc section 321 for abutting against the container convex arc section 2221, and a lid convex arc section 322 connected to the lid concave arc section 321 and abutting against the container concave arc section 2222. In this embodiment, the lid 30 is also made of PA66, but not limited thereto; the soft material surface 221 and the covering surface 31 cooperate with each other to form a negative pressure space 40, so as to achieve a better sealing effect. Specifically, when the lid 30 covers the opening 23 of the container 20, the covering surface 31 abuts against the soft material surface 221 close to the opening 23 of the container 20 so that the covering surface 31, the soft material surface 221, an abutting position between the covering surface 31 and the soft material surface 221 and an interlocking position between the limiting portion 222 and the locking portion 32 together form a negative pressure space 40.

The above is the description of the main components and the configuration of the first embodiment of the present invention. As for the operation mode and the effect of the first embodiment of the present invention, please refer to the following description.

In the first embodiment of the present invention, when the soft material structure 22 of the container 20 is combined with the lid 30 to form an interference fit, the locking portion 32 of the lid 30 presses the limiting portion 222 of the soft material structure 22, so that the limiting portion 222 of the soft material structure 22 is pressed and deformed to form pressure sealing. The above-mentioned pressure sealing technique can make the container 20 and the lid 30 tightly engage to prevent the liquid leakage from the container 20. In addition, when the container needs to be carried or stored, it only needs to fold the foldable soft material structure 24 into the shape of a round cake to change the original shape, the volume can be reduced to facilitate the user to carry.

Figure 3:
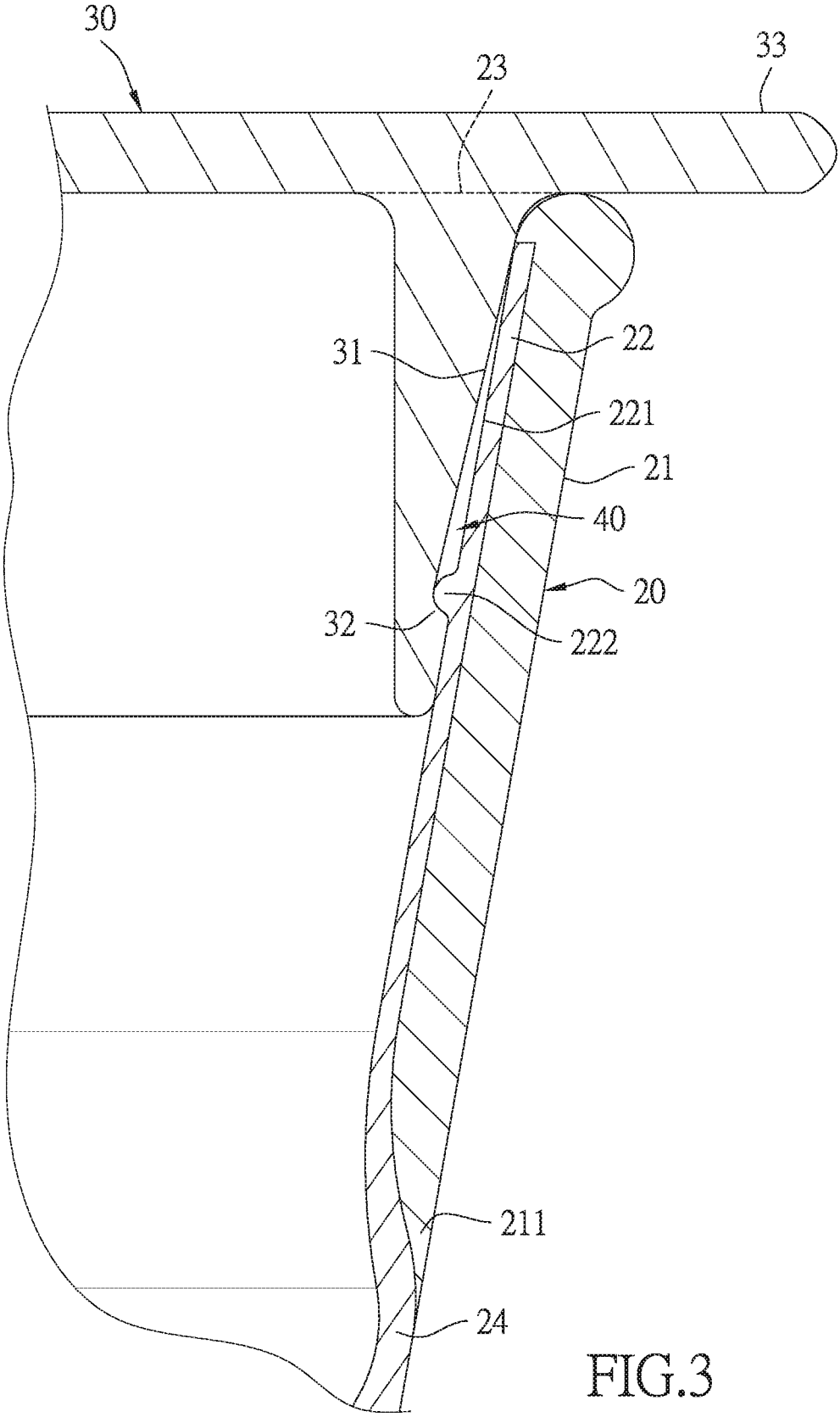
FIG. 3 is a cross-sectional view of a second embodiment of the invention.

It is worth mentioning that, as shown in FIG. 3, in the second embodiment, the foldable soft material structure 24 and the soft material structure 22 are the same structure and are connected to each other. The foldable soft material structure 24 and the soft material structure 22 are integrally formed in one processing, which makes the structure simpler to greatly reduce the manufacturing and assembly costs, and improve the practicality in terms of use.

As shown in FIG. 4, in order to achieve the foregoing objective, a sealing structure for lid and container provided by a third embodiment of the present invention also comprises the container 20 and the lid 30, which is similar to the first embodiment in terms of configuration and function, except the following differences.

The container 20 includes the opening 23 at the top, a container hard material structure 25, and a foldable soft material structure 26 connected to the container hard material structure 25. The container hard material structure 25 includes a container surface 251, a container limiting portion 252 having the container surface 251, and a connecting portion 253 connected to the foldable soft material structure 26. The container limiting portion 252 includes a container convex arc section 2521, and a container concave arc section 2522 connected to the container convex arc section 2521. In this embodiment, the foldable soft material structure 26 is made of silicone rubber, and the container hard material structure 25 is made of PA66, but not limited thereto.

The lid 30 covers the opening 23 of the container 20 to form an interference fit with the container 20, and includes a lid hard material structure 34, and a lid soft material structure 35 connected to the lid hard material structure 34. The foldable soft material structure 26 and the lid soft material structure 35 are the same structure and are not connected to each other, the lid soft material structure 35 includes a lid soft material surface 351, and a lid locking portion 352 protruding from the lid soft material surface 351 and capable of interlocking with the container limiting portion 252. The lid locking portion 352 includes a lid concave arc section 3521 for abutting the container convex arc section 2521, and a lid convex arc section 3522 connected to the lid concave arc section 3521 and abutting against the container concave arc section 2522. In this embodiment, the lid soft material structure 35 is made of silicon rubber as an example, the lid hard material structure 34 is made of PA66 as an example, but not limited thereto; the lid soft material surface 351 and the container surface 251 face each other and define a negative pressure space 50 to achieve a better sealing effect.

The above is the description of the main components and the configuration of the third embodiment of the present invention. As for the operation mode and the effect of the third embodiment of the present invention, please refer to the following description.

In the third embodiment of the present invention, when the lid soft material structure 35 of the lid 30 is combined with the container hard material structure 25 of the container 20 to form an interference fit, the container limiting portion 252 of the container hard material structure 25 presses the lid locking portion 352 of the lid soft material structure 35, so that the lid locking portion 352 of the lid soft material structure 35 is pressed and deformed to form a pressure sealing. The above-mentioned pressure sealing technique can make the container 20 and the lid 30 tightly engage to prevent the liquid leakage from the container 20. In addition, when the container needs to be carried or stored, it only needs to fold the foldable soft material structure 26 into the shape of a round cake to change the original shape, the volume can be reduced to facilitate the user to carry.

While we have shown and described various embodiments in accordance with the present invention, it is clear to those skilled in the art that further embodiments may be made without departing from the scope of the present invention.

What is claimed is:

1. A sealing structure for a lid and a container, comprising:

the container including a hard material structure, a soft material structure disposed on an inner surface of the hard material structure facing an inside of the container, and an opening at the top of the container, wherein the soft material structure includes a soft material surface facing the inside of the container, and a limiting portion, the limiting portion includes a container convex arc section and a container concave arc section connected to the container convex arc section; and the lid configured to cover the opening of the container to form an interference fit with the container, and including a covering surface facing the soft material surface, a locking portion located on the covering surface and capable of interlocking with the limiting portion, wherein the locking portion includes a lid concave arc section for abutting against the container convex arc section, and a lid convex arc section connected to the lid concave arc section and configured to abut against the container concave arc section, and when the lid covers the opening of the container, the covering surface abuts against the soft material surface close to the opening of the container so that the covering surface, the soft material surface, an abutting position between the covering surface and the soft material surface and an interlocking position between the limiting portion and the locking portion together form a negative pressure space.

2. The sealing structure for the lid and the container as claimed in claim 1, wherein the soft material structure is made of silicone, and the hard material structure is made of PA66.

3. The sealing structure for the lid and the container as claimed in claim 1, wherein the container includes a foldable soft material structure, the hard material structure includes a connecting portion connected to the foldable soft material structure and the foldable soft material structure and the soft material structure are the same structure but are not connected to each other.

4. The sealing structure for the lid and the container as claimed in claim 1, wherein the lid includes a flip portion protruding from an edge of the opening.

* * * * *